US009090440B2

(12) United States Patent
Lambert et al.

(10) Patent No.: US 9,090,440 B2
(45) Date of Patent: Jul. 28, 2015

(54) TOOL AND METHOD FOR LIFTING A RESERVOIR

(75) Inventors: Jacques Lambert, Montreal (CA); Raymond Lacroix, St-Alphonse-Rodriquez (CA); Claude Mauffette, Montreal (CA); Pierre Halmaï, Montreal (CA)

(73) Assignee: 9319-8729 QUÉBEC INC., Montreal (CA)

( * ) Notice: Subject to any disclaimer, the term of this patent is extended or adjusted under 35 U.S.C. 154(b) by 1055 days.

(21) Appl. No.: 12/926,916

(22) Filed: Dec. 17, 2010

(65) Prior Publication Data

US 2011/0163285 A1 Jul. 7, 2011

(30) Foreign Application Priority Data

Jan. 4, 2010 (GB) ..... 1000018.0

(51) Int. Cl.
*B66F 11/00* (2006.01)
*B66F 3/08* (2006.01)
*B66F 19/00* (2006.01)

(52) U.S. Cl.
CPC . *B66F 3/08* (2013.01); *B66F 19/00* (2013.01); *Y10T 29/49826* (2015.01)

(58) Field of Classification Search
USPC ..... 254/1, 93 R, 89 H, 2 B, 5 B, 5 R, 134
See application file for complete search history.

(56) References Cited

U.S. PATENT DOCUMENTS

| | | | | |
|---|---|---|---|---|
| 4,807,851 | A * | 2/1989 | De Castro | 254/1 |
| 5,379,987 | A * | 1/1995 | Cleary | 254/134 |
| 6,299,137 | B1 * | 10/2001 | Bainter | 254/89 H |
| 6,311,952 | B2 * | 11/2001 | Bainter | 254/89 H |
| 2010/0207079 | A1 * | 8/2010 | Kooima et al. | 254/1 |

* cited by examiner

*Primary Examiner* — Lee D Wilson
(74) *Attorney, Agent, or Firm* — Anglehart et al.

(57) ABSTRACT

A two-part tool for lifting from a ground surface a reservoir located substantially adjacent a wall, the reservoir defining a reservoir bottom end supported on the ground surface and a reservoir top end substantially opposed to the reservoir bottom end. The two part-tool includes: a wedge component defining a wedge component first end and a substantially opposed wedge component second end, the wedge component defining opposed first and second contact surfaces each extending between the wedge component first and second ends, the first and second contact surfaces diverging from each other in a direction leading from the wedge component first end toward the wedge component second end; a jack component, the jack component including a base, a lifting member operatively coupled to the base so as to be movable relatively thereto, and an actuator operatively coupled to the lifting member and to the base for selectively moving the lifting member relatively to the base.

2 Claims, 4 Drawing Sheets

60
59
64
48
16
10
46
50
48
52
62
52
54
44
44
14
42

40
54
55
VI
61
48
50
44
56
44
46
59
60
42
64
VI

TOOL AND METHOD FOR LIFTING A RESERVOIR

The present application claims priority from UK Request Application Serial Number 1000018.0 filed on Jan. 4, 2010, the contents of which is hereby incorporated by reference in its entirety.

FIELD OF THE INVENTION

The present invention relates generally to lifting equipment, and more specifically to tool and a method for lifting a reservoir. The present invention also relates to a method for installing a fluid containment device under the reservoir.

BACKGROUND

Hot water tank fail safe devices are known in the art and are useful in preventing water leakage from a hot water tank, which is a well known problem that typically occurs after a many years of usage of the tank.

These devices of the prior art are generally represented by a fluid containment device that typically underlies, or substantially envelops the cylindrical base portion of the tank, or they may represent a sealed fluid barrier device that is installed on the surface surrounding the base of the tank.

Some prior art devices require that they be installed prior to installing a new hot water tank, while other prior art devices can be installed at the base of an existing tank without having to dismantle the associated plumbing.

While these prior art devices generally offer a fluid containment device for hot water tanks, they also entail one or more of the following disadvantages:

a) most prior art devices generally require that they be installed prior to installing the hot water tank;

b) the prior art devices that can be installed on an existing hot water tank, thus without having to dismantle the associated plumbing, generally require a complex procedure of installation of the device under or around the base of the tank;

c) the prior art devices that can be installed on an existing hot water tank also generally integrate seam elements or sealed edges with the floor surface, which by themselves may represent a potential risk of leakage.

Accordingly, not only are many prior art fluid containment devices unsatisfactory, they are also relatively inconvenient to install under an existing hot water thank. There are also many other situations in which there is a need to lift a reservoir and for which no convenient or suitable equipment exists for doing so.

Against this background, there exist a need for a new and improved tool and method for lifting a reservoir.

SUMMARY OF THE INVENTION

In a broad aspect, the invention provides a two-part tool for lifting from a generally horizontal surface a reservoir located substantially adjacent a wall, the reservoir defining a reservoir bottom end supported on the surface and a reservoir top end substantially opposed to the reservoir bottom end. The two part-tool includes: a wedge component defining a wedge component first end and a substantially opposed wedge component second end, the wedge component defining opposed first and second contact surfaces each extending between the wedge component first and second ends, the first and second contact surfaces diverging from each other in a direction leading from the wedge component first end toward the wedge component second end; a jack component, the jack component including a base, a lifting member operatively coupled to the base so as to be movable relatively thereto a an actuator operatively coupled to the lifting member and to the base for selectively moving the lifting member relatively to the base; the two-part tool is usable to lift the reservoir from the surface by inserting the wedge component between the reservoir and the wall substantially adjacent to the reservoir top end with the wedge first end below the wedge second end, inserting at least part of the lifting member between the surface and the reservoir bottom end and using the actuator for moving the lifting member substantially vertically away from the base to lift the reservoir bottom end from the surface.

In some embodiments of the invention, the lifting member is operatively coupled to the base so as to be movable relatively thereto along a substantially rectilinear path.

In some embodiments of the invention, the jack component includes a support member extending from the base, the lifting member being mounted to the support member so as to be slidably movable therealong.

In some embodiments of the invention, the lifting member includes a lifting flange insertable between the reservoir bottom end and the bottom surface. Also, the lifting member may include a support wall extending substantially perpendicularly to the lifting flange, the support wall defining a substantially concave wall surface facing the lifting flange. For example, the concave wall surface is made out of a substantially resiliently deformable material.

In a variant, the jack component includes a pair of support members each extending from the base, the support members being parallel to each other, the lifting member being mounted to both of the support members so as to be slidably movable therealong. In some embodiments of the invention, the jack component includes a linking member extending between the support members substantially opposed to the base. For example, the linking member is substantially arc segment shaped.

In some embodiments of the invention, the lifting member includes an actuator coupler for coupling to the actuator, the actuator coupler being provided between the linking member and the base, the actuator coupler defining an actuator coupler aperture extending therethrough, the linking member defining a linking member aperture extending therethrough, the linking member and actuator coupler apertures being substantially in register with each other, the actuator including a bolt defining a bolt head and a nut, the bolt extending through the linking member and actuator coupler apertures and the nut being threaded on the bolt with the linking member and actuator coupler located between the bolt head and the nut.

In some embodiments of the invention, the base is substantially plate-shaped and the support members each extend substantially perpendicularly from the base.

In some embodiments of the invention, the wedge component includes a base plate portion defining the first contact surface and a tapered wall extending substantially away from the base plate portion and defining the second contact surface. In some embodiments of the invention, the wedge component includes a pair of tapered walls extending substantially perpendicularly away from the base plate portion in a substantially parallel relationship relatively to each other, the pair of tapered walls defining the second contact surface.

In some embodiments of the invention, the wedge component includes a handle element.

In another broad aspect, the invention provides a two-part tool for lifting from a generally horizontal surface a reservoir located substantially adjacent a wall, the reservoir defining a reservoir bottom end supported on the surface and a reservoir top end substantially opposed to the reservoir bottom end.

The two part-tool includes: a wedge component defining a wedge component first end and a substantially opposed wedge component second end, the wedge component defining opposed first and second contact surfaces each extending between the wedge component first and second ends, the first and second contact surfaces diverging from each other in a direction leading from the wedge component first end toward the wedge component second end; a jack component, the jack component including a base, a pair of support members each extending from the base, the support members being parallel to each other, a linking member extending between the support members substantially opposed to the base, the linking member defining a linking member aperture extending therethrough, and a lifting member mounted to both of the support members so as to be slidably movable therealong; and an actuator operatively coupled to the lifting member and to the base for selectively moving the lifting member relatively to the base; the lifting member including a lifting flange insertable between the reservoir bottom end and the bottom surface, a support wall extending substantially perpendicularly to the lifting flange, the support wall defining a substantially concave wall surface facing the lifting flange, and an actuator coupler for coupling to the actuator, the actuator coupler being provided between the linking member and the base, the actuator coupler defining an actuator coupler aperture extending therethrough, the actuator coupler aperture being substantially in register with the linking member aperture, the actuator including a bolt defining a bolt head and a nut, the bolt extending through the linking member and actuator coupler apertures and the nut being threaded on the bolt with the linking member and actuator coupler located between the bolt head and the nut. The two-part tool is usable to lift the reservoir from the surface by inserting the wedge component between the reservoir and the wall substantially adjacent to the reservoir top end with the wedge first end below the wedge second end, inserting the lifting member between the surface and the reservoir bottom end and moving the lifting member substantially vertically away from the base by tightening said nut on said bolt to lift the reservoir bottom end from the surface.

In another broad aspect, the invention provides a method for installing a fluid containment device under a reservoir supported on a substantially horizontal surface and defining a reservoir bottom end supported on the surface and a reservoir top end substantially opposed to the reservoir bottom end, the reservoir being located substantially adjacent a wall, the method using a wedge component defining substantially opposed first and second contact surfaces for abutting respectively against the wall and against the reservoir. The method includes: inserting the wedge component between the wall and the reservoir substantially adjacent the reservoir top end with the contact surfaces diverging from each other in a direction leading away from the surface; lifting the reservoir bottom end away from the surface substantially opposed to the wedge component; sliding the fluid containment device under the reservoir; and lowering the reservoir onto the fluid containment device. The wedge component exerts a force on the reservoir that maintains the reservoir substantially vertical when lifted from the surface to allow sliding the fluid containment device under the reservoir.

For example, lifting the reservoir bottom end away from the surface substantially opposed to the wedge component includes inserting at least part of a jack component under the reservoir bottom end and lifting the reservoir using the jack component. However, the reservoir may be lifted from the surface in any other suitable manner in other examples of embodiment of the invention.

For example, the reservoir is a conventional hot water tank generally represented by an existing hot water tank having an upstanding cylindrical format, and which is typically installed adjacent a vertical wall portion.

In some embodiments of the invention, the fluid containment device is generally represented by a sheet of flexible, yet durable water-impervious material such as, for examples, a suitable polyvinyl plastic, polyethylene, rubber, or the like, and having preferably a substantially disc-shaped configuration. The diameter of the disc-shaped fluid containment device is at least slightly larger than the diameter of the lower end portion of the upstanding cylindrical tank.

Advantageously, the present invention provides a method and a tool that allow installation of the fluid containment device under an existing reservoir without requiring necessarily, in some embodiments, the dismantling of the existing plumbing associated with the reservoir. Also, the multiple components associated with the invention, including the fluid containment device, the jack component and the wedge component are relatively simple and economical to produce and relatively easy to operate.

Other objects, advantages and features of the present invention will become more apparent upon reading of the following non-restrictive description of preferred embodiments thereof, given by way of example only with reference to the accompanying drawings.

DETAILED DESCRIPTION

Figure 1:
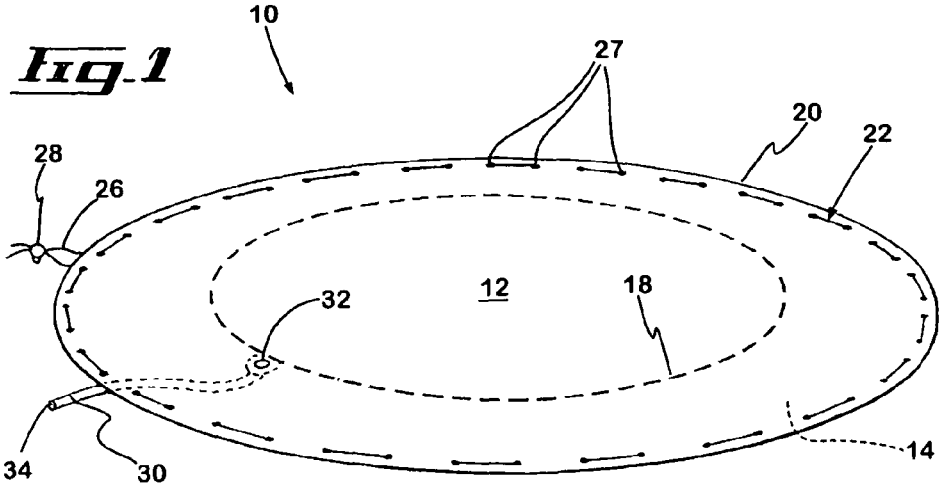
FIG. 1, in a perspective view, illustrates a fluid containment device.
Figure 4:
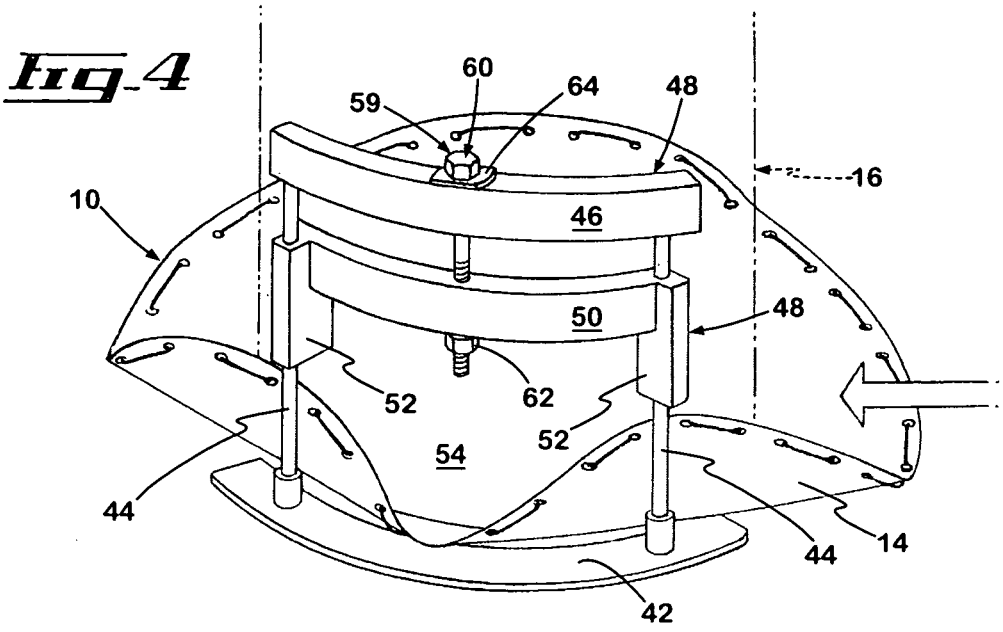
FIG. 4, in an environmental, perspective view, illustrates the fluid containment device of FIG. 1, here shown positioned under the hot water tank illustrated in FIGS. 2 and 3 raised from the floor by a jack component of the two-part tool illustrated in FIGS. 2 and 3.
Figure 8:
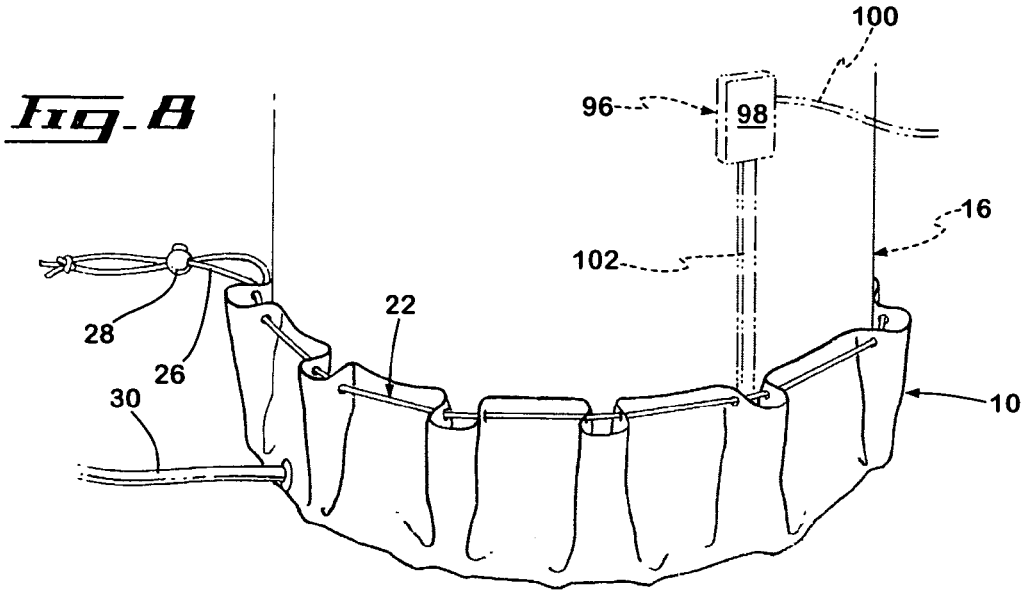
FIG. 8, in an environmental, perspective view, illustrates the fluid containment device of FIG. 1, here shown positioned under the hot water tank illustrated in FIGS. 2 and 3 raised from the floor by the jack component shown in FIGS. 5 to 7, the fluid containment device being here shown wrapped around and covering the bottom end portion of the hot water tank.

FIGS. 1, 4 and 8 show various aspects of an embodiment of a fluid containment device 10 according to the present invention. FIG. 1 shows the fluid containment device 10 that is generally represented by a sheet of flexible, yet durable water-impervious material such as, for examples, a suitable polyvinyl plastic, polyethylene, rubber, or the like, and having a substantially disc-shaped configuration. The fluid containment device 10 further defines an interior side 12 and an exterior side 14, seen in FIG. 4.

Figure 2:
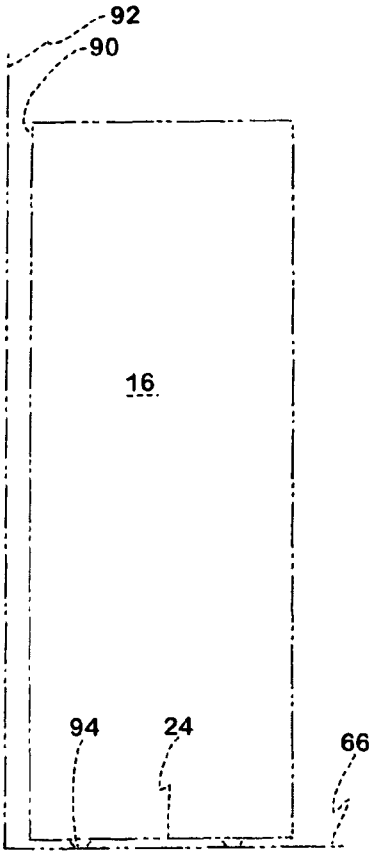
FIG. 2, in an environmental side elevational view, illustrates a conventional hot water tank, here shown typically installed on a generally horizontal surface and substantially adjacent to a wall.
Figure 3:
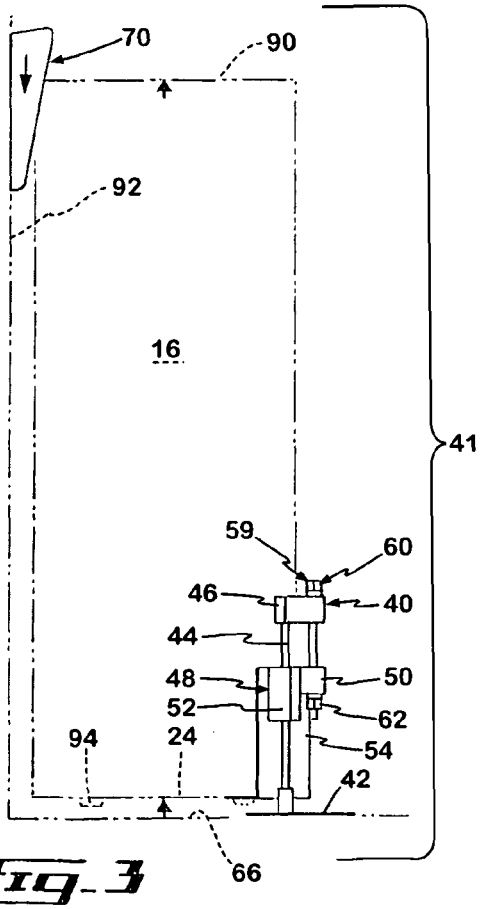
FIG. 3, in an environmental side elevational view, illustrates a two-part tool in accordance with an embodiment of the present invention, the two-part tool being shown used to install the fluid containment device of FIG. 1, with the two-part tool here shown vertically lifting the hot water tank illustrated in FIG. 2.

The radius of the disc-shaped fluid containment device 10 is at least slightly greater than the radius of the cylindrical base of a reservoir 16 to protect, such as a conventionally sized domestic hot water tank, shown in FIGS. 2, 3 and 4. It is to be understood that the fluid containment device 10 may be configured and sized to suit any other configuration or size of upstanding reservoir. The reservoir 16 is shown supported on a generally horizontal surface 66 and located substantially adjacent a wall 92. Typically, the surface 66 is a floor surface, but other possibilities are within the scope of the present invention. The reservoir 16 defines a reservoir bottom end 24 supported on the surface 66 and a reservoir top end 90 substantially opposed to the reservoir bottom end 24.

Referring to FIG. 1, a centered, inner rounded portion 18, that may be identified by a printed dashed line, or the like, on the interior side 12 of the fluid containment device 10, has a radius that is preferably substantially equivalent to the radius of the cylindrical base portion of the reservoir 16. The radial difference between the inner rounded portion 18 and the outer circumferential edge 20 of the fluid containment device 10 may represent, for example, between roughly 10% and 100% of the radius of the inner rounded portion 18.

A conventional tightening belt 22 is provided embedded along and slightly radially inwardly with respect to the outer circumferential edge 20 of the fluid containment device 10, for tightening the latter about the reservoir 16 substantially adjacent the reservoir bottom end 24 (as illustrated in FIG. 8). The tightening belt 22 may be represented, for example, by an elongated lace 26 threaded through a plurality of holes distributed along and substantially adjacent the outer circumferential edge 20 of the fluid containment device 10, and a conventional lace lock 28 for selectively locking the lace an achieved perimeter length.

FIGS. 1 and 8 show a flexible drain tube 30 of a suitable length that has a first end 32 connected through the exterior side 14 of the fluid containment device 10, and the opposite end 34 extending exteriorly therefrom. The first end 32 is preferably positioned substantially near an outer peripheral edge portion of inner rounded portion 18 and is in fluid communication with the interior side 12. The opposite end 34 of the drain tube 30 may be connected permanently to a fluid drain outlet or the like, or may be closed with an appropriately sized end plug (not shown) for occasional drainage of the fluid containment device 10.

FIGS. 3 to 7, inclusively, show various aspects of a jack component 40 of a two-part tool 41, better seen in FIG. 3, in accordance with the present invention. The two-part tool 41 also includes a wedge component 70, better seen in FIGS. 9 and 10.

Referring for example to FIG. 4, the jack component 40 includes a base 42, typically in the form of a substantially plate-shaped and arc-shaped flange, a lifting member 48 operatively coupled to the base 42 so as to be movable relatively thereto and an actuator 59 operatively coupled to the lifting member 48 and to the base 42 for selectively moving the lifting member 48 relatively to the base 42.

As described in further details hereinbelow, the two-part tool 41 is usable to lift the reservoir 16 from the surface 66 by inserting the wedge component 70 between the reservoir 16 and the wall 92 substantially adjacent to the reservoir top end 90 so that the wedge component 70 tapers in a direction leading generally downwardly, inserting at least part of the lifting member 48 between the surface 66 and the reservoir bottom end 24 and using the actuator 59 for moving the lifting member 48 substantially vertically away from the base 42 to lift the reservoir bottom end 24 from the surface 66.

Referring to FIG. 4, typically, the lifting member 48 is operatively coupled to the base 42 so as to be movable relatively thereto along a substantially rectilinear path. For example, the jack component 40 includes a support member 44 extending from the base 42, the lifting member 48 being mounted to the support member 44 so as to be slidably movable therealong. In a typical embodiment of the invention, the jack component 40 includes a pair of support members 44 each extending from the base 42, the support members 44 being parallel to each other. The lifting member 48 is mounted to both of the support members 44 so as to be slidably movable therealong. For example, the support members 44 are substantially cylindrical and project from the base 42, to which they are perpendicular.

Typically, a linking member 46 extends between the support members 44 substantially opposed to the base 42. For example, the linking member 46 is substantially arc segment shaped and disposed in a substantially parallel fashion relative to the base 42, which itself is also substantially arc segment shaped. This configuration is particularly suitable for lifting cylindrical reservoirs 16.

In the embodiment of the invention shown in the drawings, the lifting member 48 is vertically slidably engaged along the pair of parallel support members 44, between the base 42 and the linking member 46. However, the lifting member 48 may be coupled to the base 42 in any other suitable manner. The lifting member 48 typically includes a lifting flange 56 insertable between the surface 66 and the reservoir bottom end 24, a support wall 54 extending substantially perpendicularly to the lifting flange 56, the support wall 54 defining a substantially concave wall surface 55 facing the lifting flange 56 and an actuator coupler 50 for coupling to the actuator 59, the actuator coupler 50 being provided between the linking member 46 and the base 42. A pair of parallel and generally vertically disposed guide members 52 are slidably engaged on the support members 44 and mechanically coupled to the remainder of the lifting member 48. For example, the guide members 52 extend from a generally arc segment shaped actuator coupler 50 at both ends thereof and define each a through aperture for slidably receiving the support members 44 therethrough.

The actuator coupler 50 and the linking member 46 may be substantially similar in shape and size, and disposed in a substantially parallel fashion. Also, in some embodiments of the invention, the concave wall surface 55 is made out of a substantially resiliently deformable material, such as a suitable rubber, plastic, or the like, to protect the outer surface finish of the reservoir 16 when the latter is lifted by the jack component 40

Figure 6:
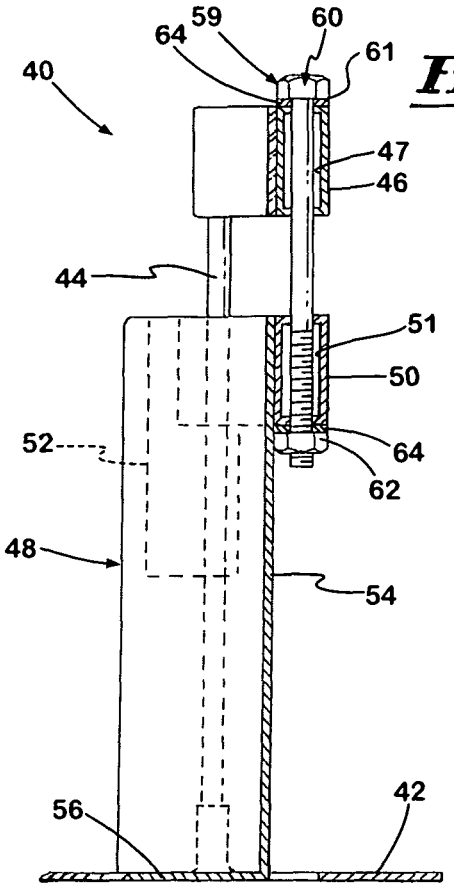
FIG. 6, in a side elevational cross-sectional taken along section line VI-VI of FIG. 5, illustrates the jack component shown in FIG. 5, the jack component being here shown with its lifting element in a lowered down position.
Figure 7:
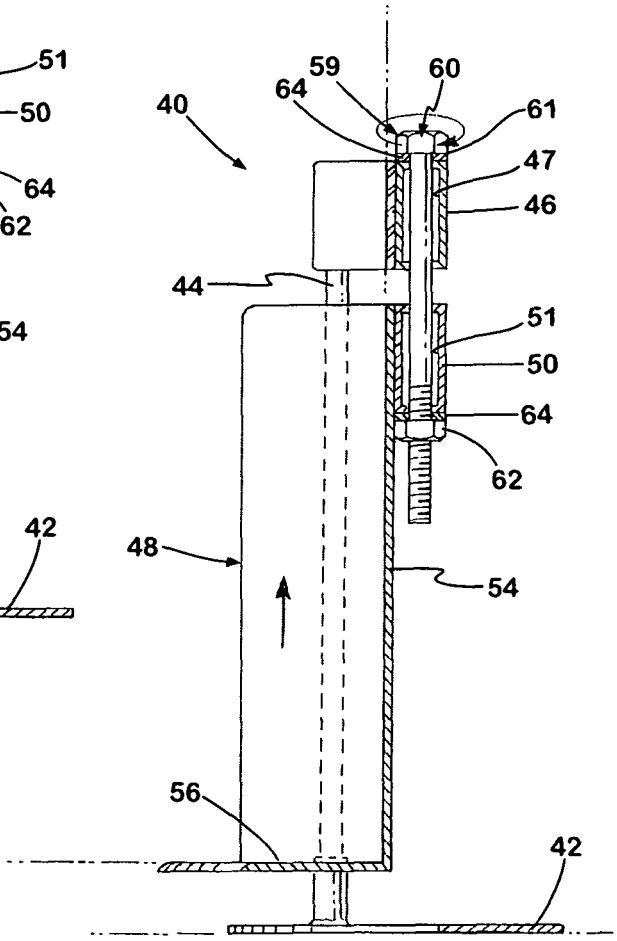
FIG. 7, in a side elevational cross-sectional taken along section line VI-VI of FIG. 5, illustrates the jack component shown in FIGS. 5 and 6, the jack component being here shown with its lifting element in a raised up position.

In some embodiments of the invention, the jack component 40 is a screw jack. As an example of such a screw jack, as seen in FIGS. 6 and 7, the actuator coupler 50 defines an actuator coupler aperture 51 extending therethrough and the linking member 46 defines a linking member aperture 47 extending therethrough, the linking member and actuator coupler apertures 47 and 51 being substantially in register with each other and substantially centrally located in the linking member 46 and actuator coupler 50. The actuator 59 includes a bolt 60 defining a bolt head 61 and a nut 62. The bolt 60 extends through the linking member and actuator coupler apertures 47 and 51 and the nut 62 is threaded on the bolt 60 with the linking member 46 and actuator coupler 50 located between the bolt head 61 and the nut 62. Typically, suitable washers 64 are slidably engaged through each of the actuator coupler aperture 51 and linking member aperture 47. However, it is to be noted that the washers 64 may as well be replaced with any other suitable anti-friction means, such as with a roller bearing element, or the like.

Figure 5:
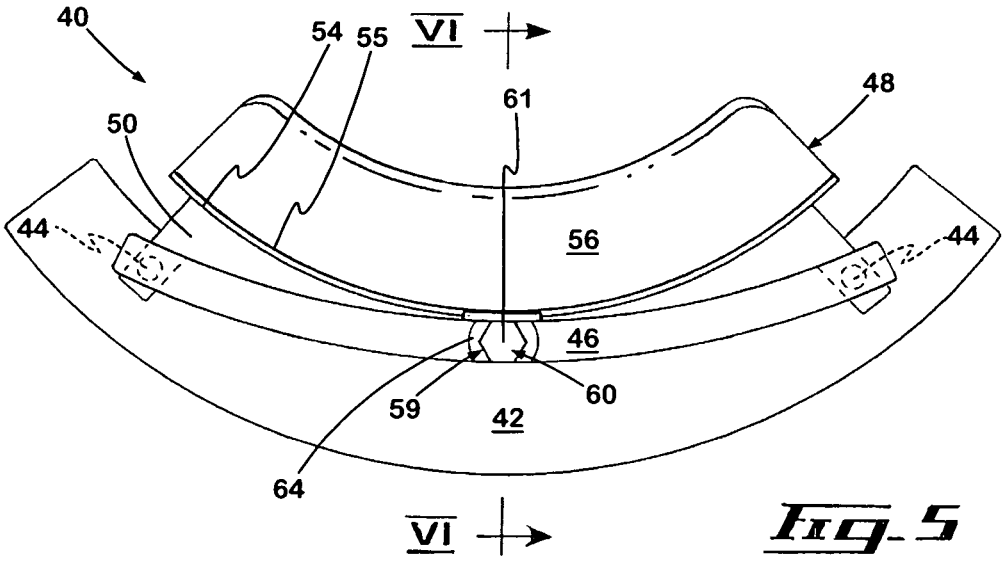
FIG. 5, in a top elevational view, illustrates a jack component of the two-part tool shown in FIGS. 2 and 3.

In some embodiments of the invention, the structural elements that compose the lifting member 48 are suitably sized and configured such that the lifting flange 56 abuts flatly against the floor, within the inner radius of the base 42, when the lifting member 48 is slidably lowered toward its lowest position, as best illustrated in FIGS. 5 and 6. Thus, by adjusting the bolt 60 and nut 62 combination of the jack component 40, it is possible to raise and lower the lifting flange 56 relative to the surface 66.

Furthermore, the arc-shaped actuator coupler 50 and the arc-shaped support wall 54 have a common inner radius that is preferably slightly greater than the radius of the reservoir 16 to lift, for example of the radius of a conventionally sized domestic hot water tank. It is to be understood that the jack component 40 may be sized to suit any other size of upstanding cylindrical or otherwise shaped reservoir 16.

Figure 9:
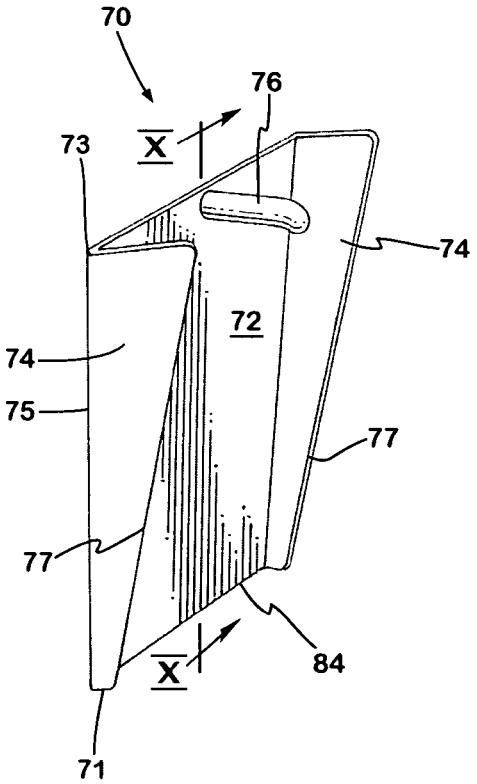
FIG. 9, in a perspective view, illustrates the wedge component of the two-part tool illustrated in FIGS. 2 and 3.
Figure 10:
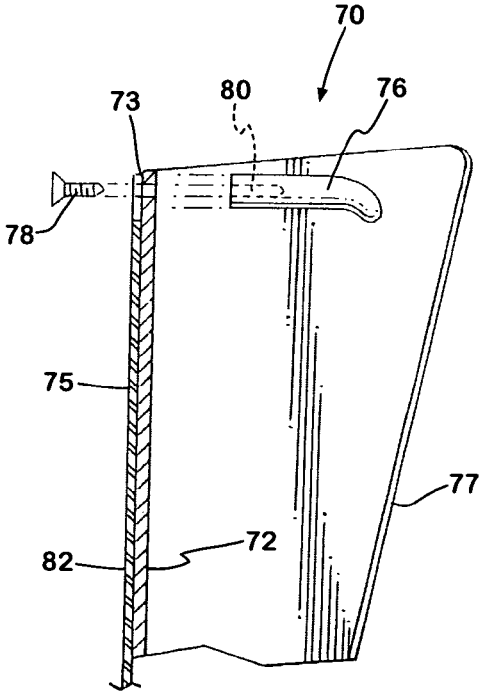
FIG. 10, in a side elevational cross-sectional exploded view taken along section line X-X of FIG. 9, illustrates the wedge component illustrated in FIG. 9.

FIGS. 9 and 10 show various aspects of the wedge component 70 of the two-part tool 41 of the present invention. In a typical embodiment, the wedge component 70 defines a wedge component first end 71 and a substantially opposed wedge component second end 73, and opposed first and second contact surfaces 75 and 77 each extending between the wedge component first and second ends 71 and 73. The first and second contact surfaces 75 and 77 diverge from each other in a direction leading from the wedge component first end 71 toward the wedge component second end 73.

In a specific example of implementation, the wedge component 70 includes a base plate portion 72 defining the first contact surface 75 and at least one tapered wall 74 extending substantially away from the base plate portion 72 and defining the second contact surface 77. Typically, a pair of tapered walls 74 extend substantially perpendicularly away from the base plate portion 72 in a substantially parallel relationship relatively to each other, the pair of tapered walls 74 defining the second contact surface 77 at their edge opposite the first contact surface 75. Therefore, the second contact surface 77, and in some embodiments, the first contact surface 75, may be discontinuous. The tapered walls 74 have, for example, a generally triangular shape. In a very specific example of implementation, the tapered walls 74 have a generally right angled triangle configuration with a peripheral side thereof that extends perpendicularly to the first contact surface 75. Also, while the tapered walls 74 are shown tapering over their entire lengths and extending through the entire space between the wedge component first and second ends 71 and 73, alternative tapered walls may only extend along a portion of the space between wedge component first and second ends 71 and 73 or may only taper along a portion thereof.

A handle element 76, such as a relatively small cylindrical member, or the like, has one end rigidly fastened to a centered portion on the inner side of the base plate portion 72, proximal the wedge component second end between the tapered walls 74.

The handle element 76 may be fastened to the inner side of the base plate portion 72 using any suitable means, such as a screw 78 and threaded hole 80 combination (as illustrated in FIG. 10), a soldering process, or the like. It is to be understood that the handle element 76 may have any other suitable shape and configuration.

Furthermore, as best illustrated in FIG. 10, the outer surface portion of the base plate portion 72 is covered with a sheet of a suitable resilient material 82 such as, for example rubber, plastic, a cork material, or the like. As it will be described in more details below, the sheet of resilient material 82 provides adherence of the wedge component 70 when the outer surface portion of the latter abuts against the wall 92, as well as providing protection to the surface finish of the wall 92.

The structural elements of the jack component 40 and the wedge component 70 are preferably made of suitably rigid and rust resistant material such as, for examples, aluminum, a suitably surface-treated steel, or the like. The choice of the materials used must take into account that the existing hot water tank may be full of water at the moment it is lifted by the jack component 40.

A typical method of installing the fluid containment device 10 under the reservoir bottom end 24 of an existing reservoir 16 that is typically installed proximal to a generally vertical wall 92, using the two-part tool 11 included in the present invention, namely the jack component 40 and the wedge component 70, is as follows.

In a first operation, the wedge component 70 has its wedge first end 71 inserted downwardly between a portion of the reservoir 16 substantially adjacent the reservoir top end 90 and the wall 92, with the first contact surface 75 facing the wall portion 92, as illustrated in FIG. 3. Thus, the tapered walls 74 provide a stable lateral support to the upper end of the reservoir 16 against the wall 92, while the reservoir 16 is slightly raised from the surface 66.

In a second operation, the jack component 40 has its lifting flange 56 in a lowered down position and inserted under the reservoir bottom end 24 at a location that is diametrically opposite the wedge component 70. It is to be noted that a conventional reservoir 16 is typically provided with low profile support heels 94, which provides a sufficient interstitial space between the bottom end wall of the reservoir 16 and the surface 66 to insert the substantially flat lifting flange 56 therebetween. However, if the support heels 94 are not provided, the lifting flange 56, or any other suitably shaped portion of the lifting member 48, can be inserted between the reservoir 16 and the surface 66 in any other suitable manner. Also, in some embodiments of the invention, the first and second operations may be reversed.

In a third operation, the bolt 60 and nut 62 combination is tightened until the reservoir 16 is sufficiently raised from the surface 66, as illustrated in FIG. 3, therefore lifting the reservoir bottom end 24 away from the surface 66 substantially opposed to the wedge component 70, such that the fluid containment device 10 may be freely slided under the reservoir 16, as illustrated in FIG. 4, with its inner rounded portion 18 identified in dashed line being substantially centered under the reservoir bottom end 24. The wedge component 70 exerts a force on the reservoir 16 that maintains the reservoir 16 substantially vertical when lifted from the surface 66 to allow sliding the fluid containment device 10 under the reservoir 16.

In a fourth operation, the lifting member 48 of the jack component 40 is lowered down, therefore lowering the reservoir 16 onto the fluid containment device 10, and the wedge component 70 is removed.

In a fifth and last operation, the peripheral edge portion of the fluid containment device 10 is raised about the cylindrical surface of the reservoir 16 in an upwardly extending skirt configuration, and the tightening belt 22 is tightened about the cylindrical wall of the reservoir 16 using the belt lock 28, as illustrated in FIG. 8. Thus, the fluid containment device 10 forms a container-like element covering the bottom end portion of the reservoir 16.

The fluid containment device 10, installed under a reservoir 16 as described above, may be used in cooperative relation with a conventional fluid detection device 96 such as illustrated in FIG. 8. The fluid detection device 96 may be typically represented by a battery, or electrically operated module 98, through a power cord 100 as illustrated, that is linked to a water detection sensor 102 positioned proximal the inner bottom end of the fluid containment device 10. Thus, the fluid detection device 96 may warn a user by emitting an audible signal when it is detecting the presence of water therein, due to a leaking reservoir 16.

It is to be understood that any other suitable configuration of the fluid detection device 96 may be used. For examples, the fluid detection device 96 may integrate an additional water detection sensor (not shown) that is preferably positioned outside the fluid containment device 10, proximal the base of the reservoir 16, for detecting any leaks occurring on the floor, outside the fluid containment device 10. Furthermore, the fluid detection device 96 may be further linked to a central alarm system interface, for a remote access to a warning generated by the detection device 96.

Although the present invention has been described hereinabove by way of preferred embodiments thereof, it can be modified, without departing from the spirit and nature of the subject invention as defined in the appended claims.

What is claimed is:

1. A method for installing a fluid containment device under a reservoir supported on a substantially horizontal surface and defining a reservoir bottom end supported on said surface and a reservoir top end-substantially opposed to said reservoir bottom end, said reservoir being located substantially adjacent a wall, said method using a wedge component defining substantially opposed first and second contact surfaces for abutting respectively against said wall and against said reservoir, said method comprising:

inserting said wedge component between said wall and said reservoir substantially adjacent said reservoir top end with said contact surfaces diverging from each other in a direction leading away from said surface;

lifting said reservoir bottom end away from said surface substantially opposed to said wedge component;

sliding said fluid containment device under said reservoir, and lowering said reservoir onto said fluid containment device;

wherein said wedge component exerts a force on said reservoir that maintains said reservoir substantially vertical when lifted from said surface to allow sliding said fluid containment device under said reservoir.

2. A method as defined in claim 1, wherein lifting said reservoir bottom end away from said surface substantially opposed to said wedge component includes inserting at least part of a jack component under said reservoir bottom end and lifting said reservoir using said jack component.

* * * * *